US005351051A

United States Patent [19]

Yano et al.

[11] Patent Number: 5,351,051

[45] Date of Patent: Sep. 27, 1994

[54] TRANSMISSION DEVICE

[75] Inventors: Tsunenori Yano; Munemasa Matsushita, both of Miyazaki, Japan

[73] Assignee: Honda Lock Mfg. Co., Ltd., Miyazaki, Japan

[21] Appl. No.: 903,907

[22] Filed: Jun. 25, 1992

[30] Foreign Application Priority Data

Jun. 25, 1991 [JP] Japan ..... 3-78685[U]

[51] Int. Cl.[5] ..... G08C 19/12

[52] U.S. Cl. ..... 341/176; 361/818; 340/825.72; 174/52.1; 174/35 R

[58] Field of Search ..... 174/35 R, 51, 52.1, 174/52.4; 361/424, 212, 380; 340/825.31, 825.36, 825.72; 341/176

[56] References Cited

U.S. PATENT DOCUMENTS

| | | | |
|---|---|---|---|
| 4,146,291 | 3/1979 | Goff et al. | 339/111 |
| 4,829,432 | 5/1989 | Hershberger et al. | 174/51 X |
| 5,111,199 | 5/1992 | Tomoda et al. | 341/176 X |
| 5,124,889 | 6/1992 | Humbert et al. | 174/51 X |
| 5,140,108 | 8/1992 | Miyajima | 361/212 X |
| 5,206,796 | 4/1993 | Thompson et al. | 174/51 X |

*Primary Examiner*—John K. Peng
*Assistant Examiner*—Tim Johnson
*Attorney, Agent, or Firm*—Longacre & White

[57] ABSTRACT

A transmission device having a transmission circuit contained within a casing made of a synthetic resin for transmitting a locking or unlocking signal, wherein an earth plate is disposed between the casing and the transmission circuit. Static charges accumulated on a human body scarcely flow to the transmission circuit upon handling the transmission device, thus eliminating the worry that the electric components of the transmission device are damaged by a surge current.

8 Claims, 5 Drawing Sheets

TRANSMISSION DEVICE

BACKGROUND OF THE INVENTION

1. Field of the Invention

The present invention relates to a transmission device having an electric circuit. For example, a transmission circuit contained within a casing made of a synthetic resin for locking and unlocking a vehicle door locking member by remote control.

2. Description of the Prior Art

The transmission device of the aforementioned type bas been proposed and known, for example, in Japanese Laid Open Patent No. 288592,1990.

In this type of transmission device, it is necessary to minimize the size to make the device portable. Accordingly, a circuit board to which a transmission circuit is attached or incorporated is generally contained within a casing. Usually, this type of transmission device has a pushbutton, which is exposed on the surface of the casing, for transmitting a locking or unlocking signal. Further, the casing is often a combined structure comprising an upper case and a lower case during the assembling operation. Once assembled the circuit board is disposed near the switchcover and the joining faces of the casing.

When a user holds the transmission device in his hand as it contacts, or comes close to, an external ground, static charge accumulated in the body of the user tends to flow to the ground through the transmission device. Such an event might occur when the driver of a car holds a door open with the same hand used to hold the transmission device. A flow of charge, or a surge current, will occur if the voltage caused by the accumulated charge reaches a high enough level to break down all of the dielectric between the driver and the external ground. The dielectric between the driver's body and the external ground includes air gaps between conductive elements of the transmission device or solid dielectric materials such as portions of a plastic casing. The charge will flow, if the voltage is high enough, through the path of weakest dielectric strength. Points along such a path may include a thin-walled section of the switch cover, the joining face of the upper case and the lower case, or through a metal bolt used to secure a cover portion of the case. This path would also include the elements of the transmission circuit because of presence of interconnected conductive and semiconductive circuit elements. The possibility of such a breach and the consequent establishment of such a surge current in the circuit board can destroy IC chips or other circuit elements.

OBJECT AND SUMMARY OF THE INVENTION

Accordingly, it is an object of the present invention to overcome the foregoing problem in the prior art.

To overcome the foregoing problem, internal circuits can be protected by ground plates near the low dielectric strength portions of the casing.

BRIEF DESCRIPTION OF THE ACCOMPANYING DRAWINGS

These and other objects, as well as advantageous features of the present invention will become apparent by reading the following descriptions for the preferred embodiment according to the present invention with reference the accompanying drawings, wherein.

DESCRIPTION OF THE PREFERRED EMBODIMENT

Figure 1:
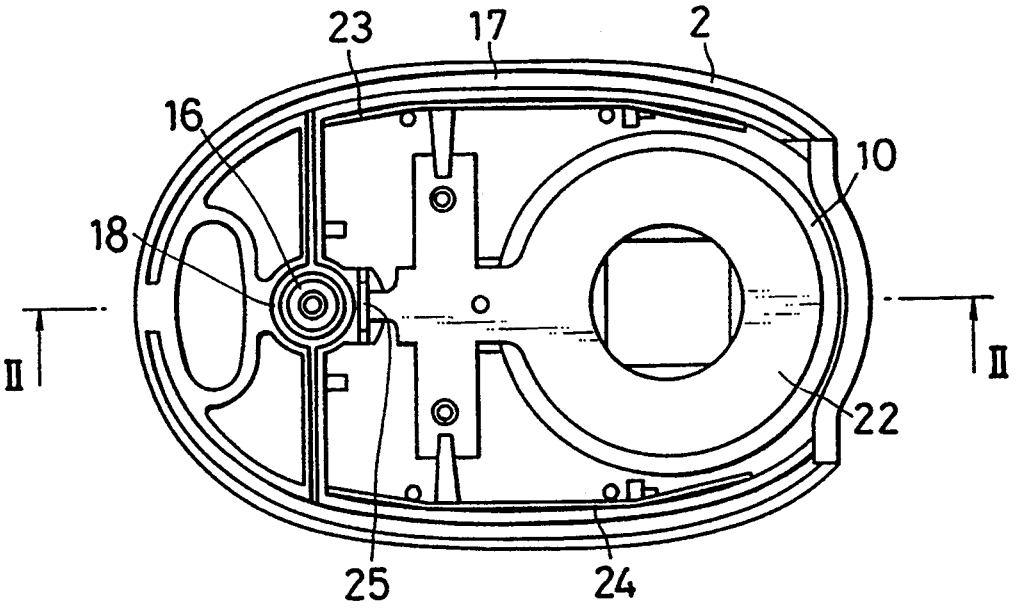
FIG. 1 is a bottom view of an upper case for a transmission device according to the present invention.
Figure 2:
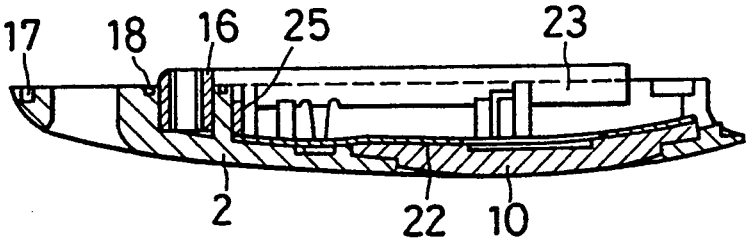
FIG. 2 is a cross sectional view taken along lines II—II in FIG. 1.
Figure 3:
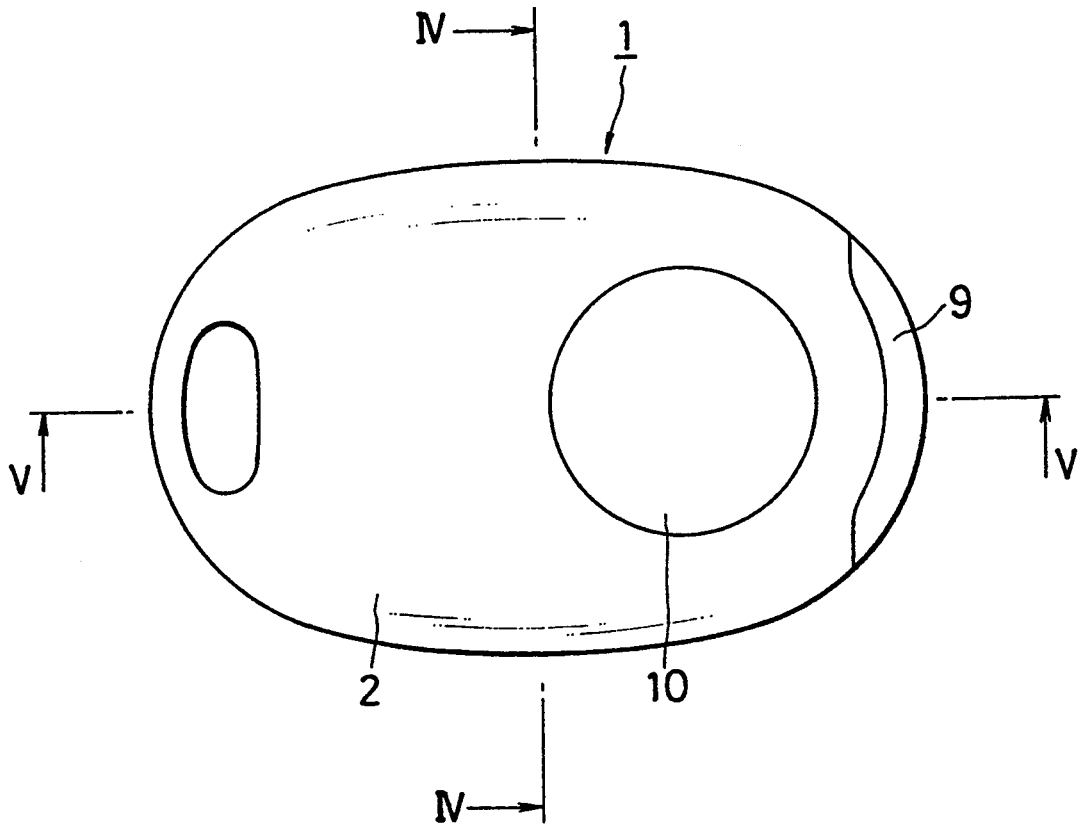
FIG. 3 is a plan view of the transmission device according to the present invention.
Figure 4:
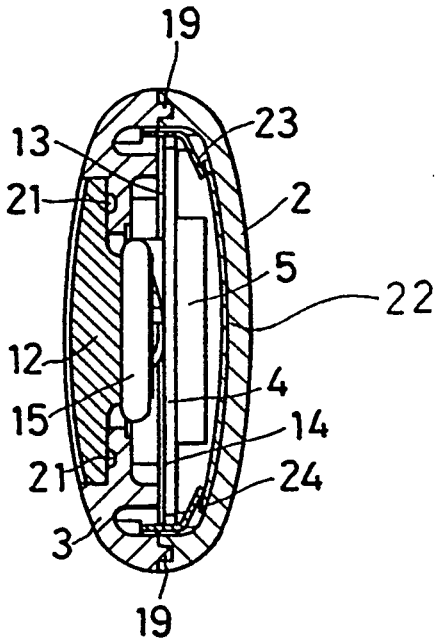
FIG. 4 is a cross sectional view taken along lines IV—IV in FIG. 3.
Figure 5:
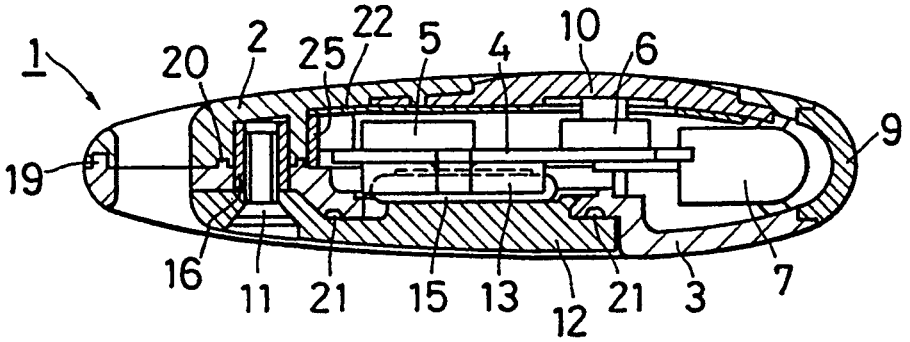
FIG. 5 is a cross sectional view taken along lines V—V in FIG. 3.
Figure 6:
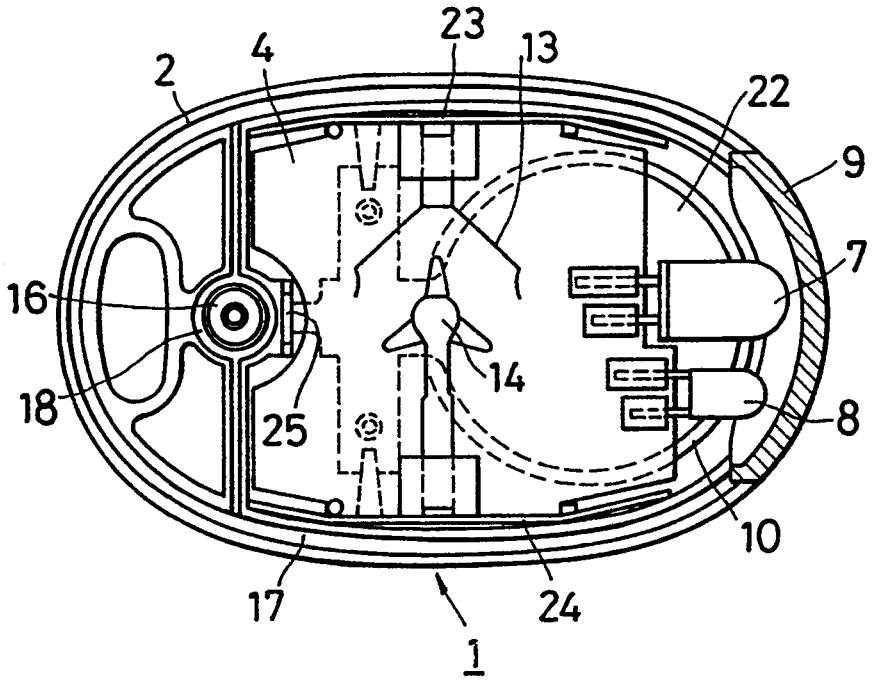
FIG. 6 is a bottom view illustrating the transmission device according to the present invention in a state where a lower case is removed.

The present invention will now be described by way of a preferred embodiment together with reference to the drawings.

As shown in FIG. 3 to FIG. 6, a transmission device 1 comprises an upper case 2 and a lower case 3 each made a synthetic resin and secured to each other by adhesion bonding.

The upper case 2 has an insert nut 16 fitted into and secured to the lower surface thereof, so that a metal bolt 11 can be screwed into the insert nut 16 when a cover 12, described later, is attached to the lower case 3. Further, the upper case 2 has a recessed groove 17 formed along the entire circumference thereof and a recessed groove 18 around the periphery of the insert nut 16. Additionally, the lower case 3 has ridges 19 and 20 formed thereon corresponding to the recessed grooves 17 and 18 respectively. The upper case 2 and the lower case 3 are secured to other by adhesion bonding by injecting adhesives into the recessed grooves 17 and 18 and fitting the ridges 19 and 20 to the recessed grooves 17 and 18 respectively.

A light permeable lens made of a synthetic resin hereinafter simply referred to as a lens) 9 is secured by adhesion bonding at the top end of the transmission device 1. Further, the upper case 2 contains a printed circuit board 4, an IC chip 5 incorporated with a transmission device or the like and a circuit element such as a switch mounted on the upper surface of the printed circuit board 4. A flexible switchcover 10 made of rubber is disposed on the surface of the upper case 2. A switch 6 can be turned ON by pressing a top surface of switch cover 10 causing switch cover 10 to bend, thereby pressing switch 6. Additionally, a positive terminal 13 and a negative terminal 14 are disposed in a lower surface of the printed circuit board 4. The positive terminal 13 and the negative terminal 14 are brought into contact with each of the electrodes of an electric cell 15 contained in the lower case 3. The lower case has a cover 12 detachably mounted thereto by a metal bolt 11 screwed into the insert nut 16, so that the electric cell 15 can be replaced easily. An o-ring 21 is inserted between the cover 12 and the lower case 3, to keep water from intruding into the transmission device 1.

Further, an infrared ray emitting element 7, for transmitting the locking or unlocking signals, and a monitoring visible light element 8, for confirming the transmission state of the signal, are disposed side by side opposite lens 9. The infrared emission element 7 and the monitoring visible ray element 8 are electrically connected to the transmission circuit, Thus, when the switchcover 10 is pressed, the transmission circuit is actuated by means of the switch 6 and, since an infrared code signal is transmitted from the infrared emitting element 7 depending on the output signal from the transmission circuit, a door lock member disposed on the side of a vehicle can be locked or unlocked by remote control.

As shown in FIGS. 1, 2 and 4 to 6, a first ground plate 22 made of a flexible thin metal foil is appended to the lower surface of the switchcover 10. Further, second ground plates 23 and 24 are disposed on the inside of the transmission device 1 in the vicinity of the joining face between the upper case 2 and the lower case 3. The second ground plates 23 and 24 are connected, respectively, to the first ground plate 22. Further, a third earth plate 25 is disposed near the insert nut 16, and the third ground plate 25 is also connected to the first ground plate 22.

Figure 7:
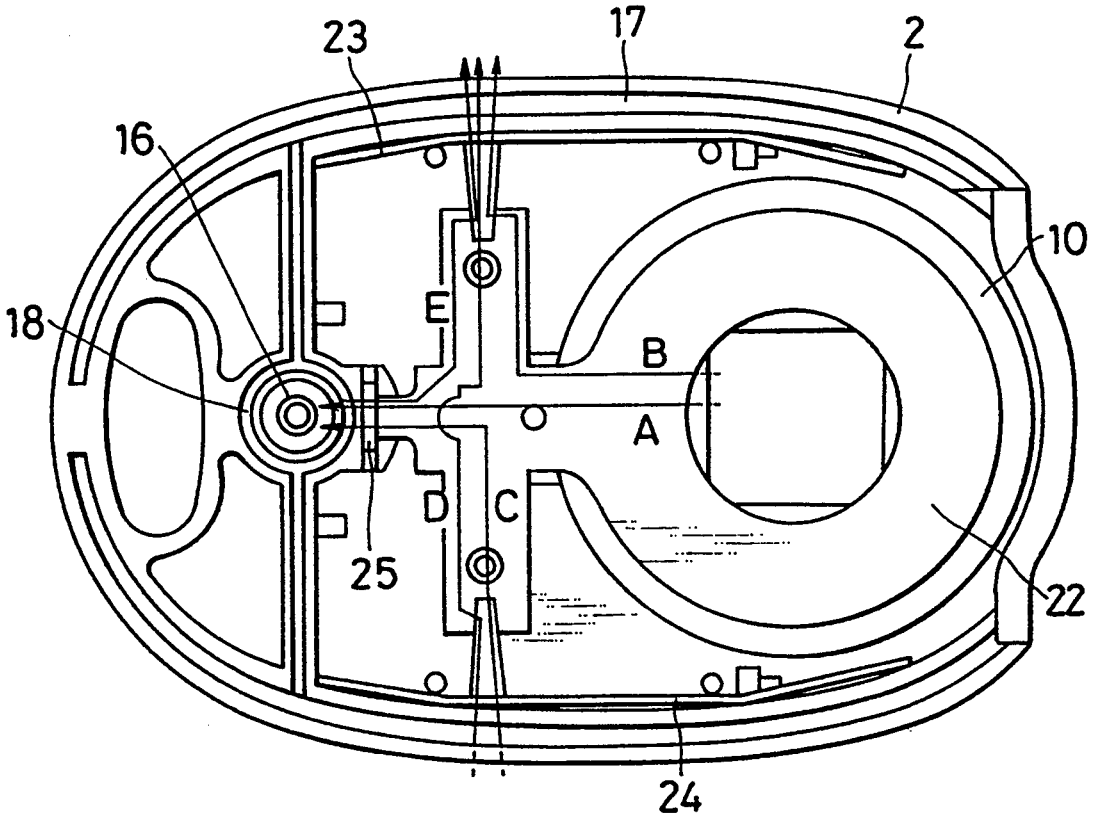
FIG. 7 is a bottom view for illustrating the operation of the transmission device according to the present invention.

Description of the operation of this embodiment follows: If a driver happens to touch the transmission device 1 to a metal part of a vehicle, a surge current may occur within the transmission device 1. This surge current results when a portion of transmission device 1 with low dielectric strength, such as a portion of the casing near the metal bolt 11 is brought into contact with an electrical ground such as a metal part of the vehicle while the driver's finger is in contact with another low dielectric strength portion of the casing such as switch cover 10, static charges accumulated in a driver's body flow through the second low dielectric strength portion of the casing switchcover into the transmission device 1 ( refer to FIG. 5) and out of the transmission device through the first low dielectric strength portion of the casing. The charge flows through the low dielectric strength portions when the accumulation of charge causes the breakdown voltage of the dielectric to be exceeded. This happens more readily in portions of the casing having relatively low dielectric strength. In this case, the static charges flow at first to the first ground plate 22, then from the third ground plate 25 by way of the joining face between the upper case 2 and the lower case 3 to the insert nut 16 and finally flow by way of an metal bolt 11 to the external ground, not shown, (refer to an arrow A in FIG. 7). When an external ground body is present near the joining face between the upper case 2 and the lower case 3, static charges entering through the low-dielectric-strength thin-walled portion of the switchcover 10 into the transmission device 1 flow at first to the first ground plate 22 then from the second ground plate 23 (or 24) to ground, by way of the joining face between the upper case 2 and the lower case 3 body (along an arrow B In FIG. 7).

Further, when the portion near the metal bolt 11 is brought into contact with the external ground body in a state where the driver's finger touches the joining face between the upper case 2 and the lower case 3, static charges accumulated in the driver's body pass through the joining face between the upper case 2 and the lower case 3, as a result of the breakdown of the dielectric in this area of weak dielectric strength, and flow into the transmission device 1. In this case, the static charges flow first through the second ground plate 24 (or 23) on one side to the first ground plate 22 and then from the third ground plate 25 by way of the .joining face between the upper case 2 and the lower case 3, to the insert nut 16 and finally flow by way of the metal bolt 11 to the external ground (as shown by an arrow C in FIG. 7). If an external ground body is present near the joining face between the upper case 2 and the lower case 3, static charges intruding through the joining face between the upper case 2 and the lower case 3 into the transmission device 1 flow From the second ground plate 24 (or 23) on one side by way of the first ground plate 22 to the second earth plate 23 ( or 24 ) on the other side, and then flow by way of the joining face between the upper case 2 and the lower case 3 to the external ground body (as shown by an arrow D in FIG. 7).

Further, when the joining face between the upper case 2 and the lower case 3 are brought into contact with an external ground body while the driver's finger touches a portion near the metal bolt 11, static charges accumulated on a driver's body intrude through the metal bolt 11 into the transmission device 1 the high voltage caused by the static charge causing breakdown of the dielectric (the intervening air or a part of the casing) between the driver's finger and bolt 11. In this case the static charges at first flow from the insert nut 16 by way of the joining face between the upper case 2 and the lower case 3 to the third ground plate 25, then flow from the First ground plate 22 to the second ground plate 23 (or 24) and finally flow by way of the joining face between the upper case 2 and the lower case 3 to the external ground body (refer to an arrow E in FIG. 7). Again, the flow of charge through the joining face is caused by the breakdown of the dielectric at this region of weak dielectric strength. Where the pushbutton is in contact with the external ground body, the static charges intruding through the metal bolt 11 or the joining face between the upper case 2 and the lower case 3 into the transmission device 1 flow by way of the third ground plate 25 or the second ground plate 23 or 24 to the first ground plate 22 and then flow through the thin walled portion of the switch cover 10, as a result of the breakdown of the dielectric in switch cover 10, to the external ground body (in the direction opposite to the arrow A, B shown in FIG. 7). In this way, static charges accumulated in the driver's body scarcely flow into the transmission circular or the like. Hence, there is no concern that the circuit elements could be destroyed and deteriorate the function of the transmission device.

As has been described above, in the transmission device according to the present invention in which a transmission circuit for transmitting a locking or unlocking signal is contained within a casing made of a synthetic resin, since a ground plate is disposed between the casing and the transmission circuit, static charges accumulated in a driver's body scarcely flow to an electric circuit such as a transmission circuit and, accordingly, it has an excellent effect capable of preventing destruction of the circuit device and eliminating concern of deteriorating the function of the transmission device.

What is claimed is:

1. A transmission device comprising:

a transmission circuit for transmitting a remote control signal for locking and unlocking a vehicle door;

a casing containing said transmission circuit;

at least two portions of said casing having lower dielectric strengths than at least one other portion of said casing;

a plurality of grounding plates between said transmission circuit and said casing;

each of said at least two portions being adjacent to at least one of said plurality of grounding plates;

means for electrically interconnecting said plurality of ground plates, whereby a conductive path joining said at least two portions is established.

2. A transmission device, comprising:

a transmission circuit for transmitting remote control signals for remotely locking and unlocking a vehicle door;

a casing containing said transmission circuit;

said casing having weak-dielectric portions and strong-dielectric portions;

said weak-dielectric portions and said strong-dielectric portions having respective inner faces facing an inside of said casing and respective outer faces facing away from said inside;

said weak-dielectric portions having lower dielectric strengths than said strong-dielectric portions; and at least one conductive element in said casing for electrically connecting said inner face of at least one of said weak-dielectric portions with said inner face of at least another of said weak-dielectric portions, whereby a low resistance path is established between said inner face of said weak-dielectric portions and said outer face of said at least another.

3. Apparatus as in claim 2, wherein:

said transmission circuit includes a switch for controlling said transmission circuit;

said casing includes a flexible cover covering said switch;

said at least one of said weak-dielectric portions includes said flexible cover; and said at least one conductive element includes a first ground plate beneath said flexible cover.

4. Apparatus as in claim 2, wherein:

said casing includes at least two casing elements;

said at least two casing elements are connected along an interface between said at least two casing elements;

said at least one of said weak-dielectric portions includes at least a portion of said interface; and said at least one conductive element includes a second ground plate between said transmission circuit and said interface.

5. Apparatus as in claim 2, wherein:

said casing includes a cover;

said cover retains a battery inside said casing;

said at least one of said weak-dielectric portions includes a metal bolt securing said cover; and said at least one conductive element includes a first ground plate adjacent to said metal bolt.

6. A transmission device, comprising:

a transmission circuit for transmitting remote control signals for remotely locking and unlocking a vehicle door;

a casing containing said transmission circuit;

said casing including an upper case and a lower case joined at a joining face between said upper case and said lower case;

said upper case including a flexible switch cover forming a portion of said casing;

said flexible switch cover covering a switch that controls said transmission circuit;

a first ground plate beneath said flexible switch cover;

a second ground plate between said transmission circuit and said joining face of said casing; and means for electrically connecting said first ground plate and said second ground plate.

7. A transmission device, comprising:

a transmission circuit for transmitting remote control signals for remotely locking and unlocking a vehicle door;

an electric cell;

a casing containing said transmission circuit;

said casing including an upper case and a lower case joined at a joining portion between said upper case and said lower case;

said lower case including a detachably mounted cover for said electric cell for replacement of said electric cell;

said cover for said electric cell being secured by a metal bolt;

a first ground plate near said bolt;

a second ground plate between said transmission circuit and said joining portion; and means for electrically connecting said first ground plate and said second ground plate.

8. A transmission device, comprising:

a transmission circuit for transmitting remote control signals for remotely locking and unlocking a vehicle door;

a casing containing said transmission circuit;

said casing being made of synthetic resin;

said casing including a cover;

said cover retaining a battery inside said casing;

said cover being secured by a metal bolt;

a first ground plate adjacent to said metal bolt;

said transmission circuit including a switch for controlling said transmission circuit;

said casing including a flexible cover covering said switch;

a second ground plate adjacent to said flexible cover; and means for electrically connecting said first ground plate to said second ground plate.

* * * * *